United States Patent [19]

Johnson et al.

[11] Patent Number: 4,635,871

[45] Date of Patent: Jan. 13, 1987

[54] MANDREL LOCKING MECHANISM

[75] Inventors: Peter A. Johnson; William A. Olesen, both of Green Bay, Wis.

[73] Assignee: Paper Converting Machine Company, Green Bay, Wis.

[21] Appl. No.: 776,904

[22] Filed: Sep. 17, 1985

[51] Int. Cl.[4] ..... B65H 16/02; B65H 75/18

[52] U.S. Cl. ..... 242/68.3; 242/72 R

[58] Field of Search ..... 242/72 R, 72.1, 72 B, 242/68.2, 68.3; 269/48.1; 279/2 R

[56] References Cited

U.S. PATENT DOCUMENTS

| | | | |
|---|---|---|---|
| 2,757,875 | 8/1956 | Gollos et al. | 242/72 X |
| 2,769,600 | 11/1956 | Kwitek et al. | 242/56 |
| 2,901,192 | 8/1959 | Nystrand | 242/75.5 |
| 2,931,590 | 4/1960 | Nystrand | 242/72 |
| 2,995,314 | 8/1961 | Nystrand | 242/64 |
| 3,331,565 | 7/1967 | Gerritts | 242/72.1 |

*Primary Examiner*—Stuart S. Levy
*Assistant Examiner*—Thomas R. Hannon
*Attorney, Agent, or Firm*—Tilton, Fallon, Lungmus & Chestnut

[57] ABSTRACT

A rewinder mandrel, wherein separate adjustment is provided for positioning the core locking lugs and for adjusting the spring tension for pivoting the lugs to uncammed position; and in which novel replacable core lugs are provided, having a bifurcation providing legs facilitating snap-in assembly.

6 Claims, 5 Drawing Figures

FIG. 1
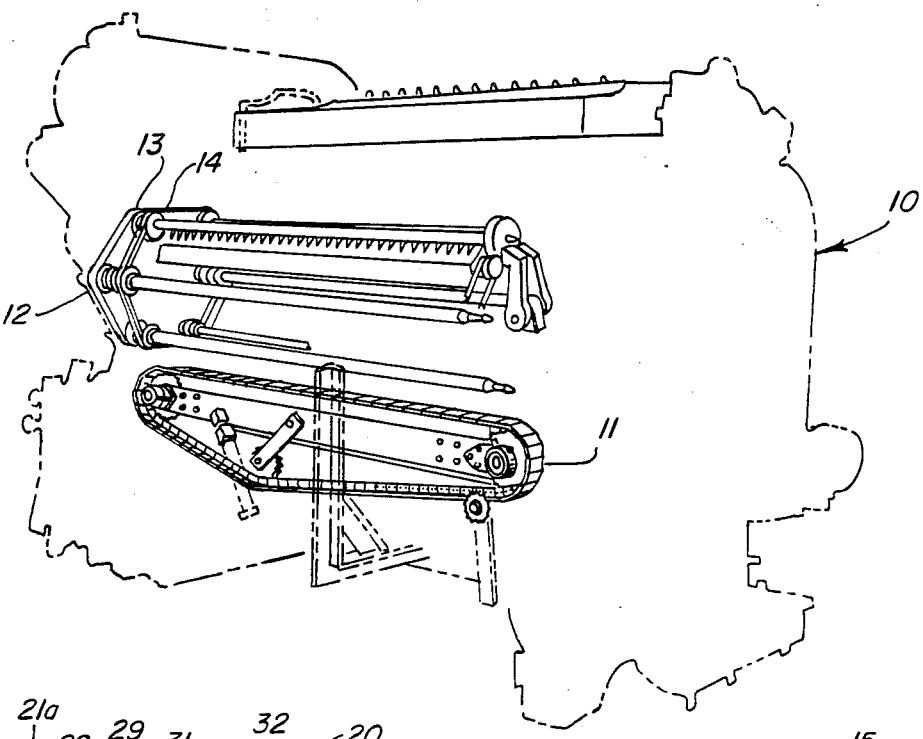
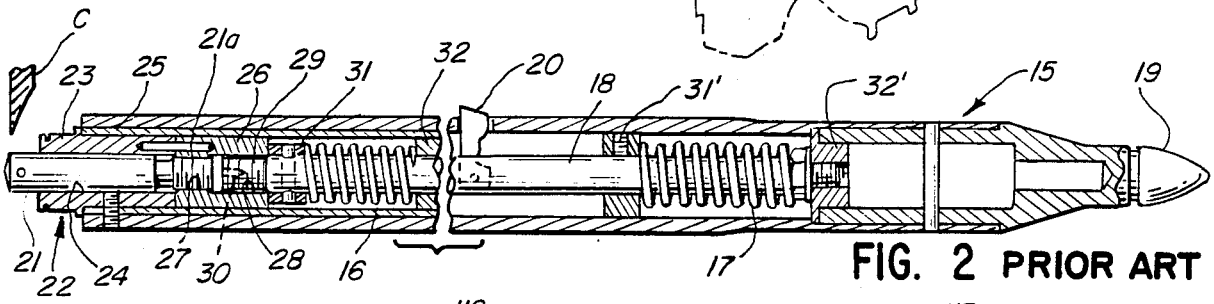
FIG. 2 PRIOR ART
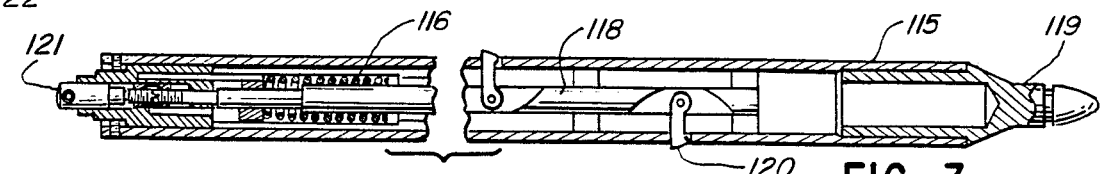
FIG. 3
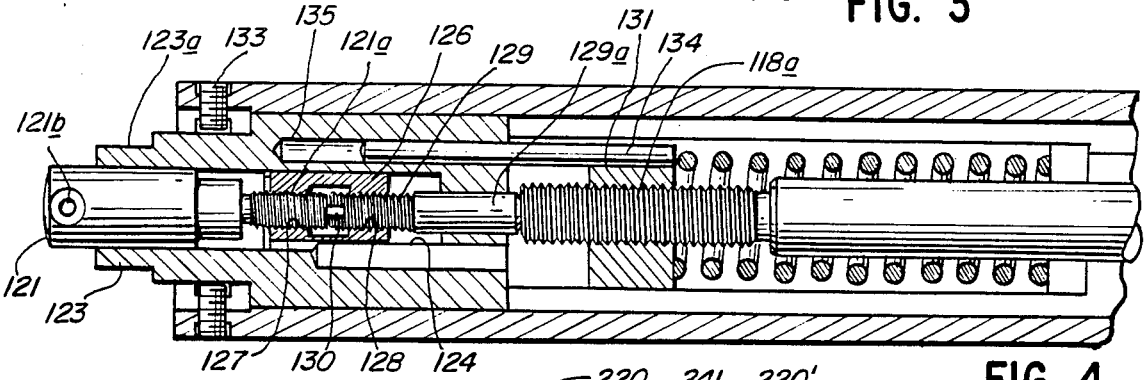
FIG. 4
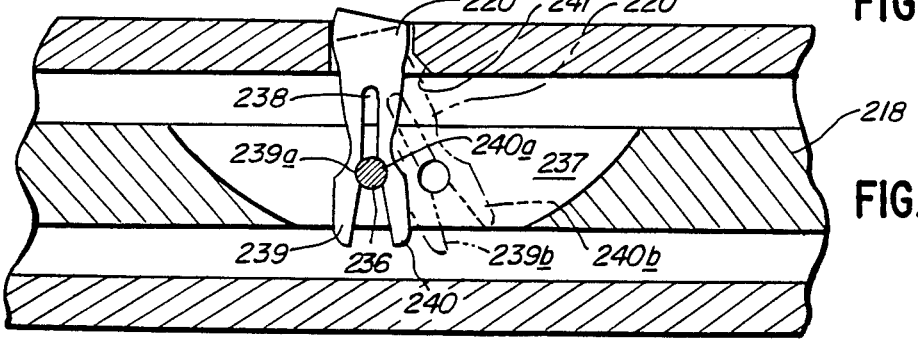
FIG. 5

MANDREL LOCKING MECHANISM

BACKGROUND AND SUMMARY OF INVENTION

This invention relates to a mandrel locking mechanism and, more particularly, to a mandrel utilized for the winding of webs at high speed.

One of the earliest automatic, continuous rewinders is seen in co-owned U.S. Pat. No. 2,769,600. These rewinders were adapted to operate without slow-down or interruption when a given retail-size web roll was completed. For this purpose, the winder was equipped with a turret which contained a plurality of mandrels, which were indexed in an orbit so as to have a mandrel ready to take up the winding operation when a previous mandrel had completed it, winding cycle.

Prior to entering into a winding cycle, the mandrel was ensleeved with a cardboard core. The core was equipped with adhesive for coupling the leading edge portion of the relatively flimsy web to the core. Further, the mandrel was equipped with locking lugs (sometimes referred to as "fingers" or "dogs") to fix the core both rotationally and axially to the mandrel. An improved mandrel for the early automatic, continuous machines is seen in co-owned U.S. Pat. Nos. 2,901,192 and 2,931,590.

With the advent of wider, higher speed rewinders in the 1960's, the earlier mandrels were considered inadequate and an improved mandrel, as shown in co-owned U.S. Pat. No. 3,331,565, was tried. However, this also was inadequate and the earlier version of the '192 patent was modified.

More particularly, the modification included a mechanism for adjusting the position of the core locking mechanism and the introduction of a second spring axially spaced from the original spring.

Over the years, this double spring construction presented many problems, particularly in the alignment of the locking lugs, the utilization of the adjustment feature and distortion of the locking mechanism.

These problems have been solved by the instant invention by providing separate means for adjusting the locking lug position and the spring pressure in a compact arrangement and also providing readily replaceable lugs arranged to properly grip cores while being constructed to remain in place under the high centrifugal forces generated by rotational speeds of several thousand revolutions per minute.

Other objects and advantages of the invention may been seen in the details of construction and operation as set forth hereinafter.

The invention is described in conjunction with the accompanying drawing, in which FIG. 1 is a perspective view, partially in outline, of a rewinder which constitutes the environment for the inventive mandrel;

FIG. 2 is a fragmentary axial sectional view of a mandrel constructed according to the most recent prior art;

FIG. 3 is a fragmentary axial section view of a mandrel embodying teachings of the invention but utilizing old-style core lugs;

FIG. 4 is a fragmentary enlarged view of the left-hand portion of FIG. 3; and

FIG. 5 is a fragmentary axial sectional view showing new-style core lugs according to the instant invention.

DETAILED DESCRIPTION

The numeral 10 designates, generally, a rewinder (sometimes referred to as a "winder"), which constitutes the environment for the instant invention. The rewinder is employed for converting a jumbo roll of web material, toilet paper, toweling, foil, film, etc., into retail-size rolls. More particularly, a jumbo roll may measure upwards of seven feet in diameter and ten feet in axial length. This is unwound in the rewinder, perforated—if desired, and rewound into logs having a diameter of the conventional retail-size toilet paper or toweling, etc., rolls. To develop the consumer product, the logs are conducted away from the rewinder as by the take away conveyor 11 to a logsaw (not shown).

For automatic operation, the rewinder has a turret 12 which supports a plurality of mandrels. The mandrels are elongated shafts which are ensleeved by the cardboard cores and processed through a cycle of glue application, transfer of the leading edge of a web to the glue-equipped core, winding and log stripping from the mandrel. In the illustration given, each mandrel is equipped with a pair of pulleys 13, 14, which receive belts for the purpose of bringing the mandrel up to web speed for web transfer and thereafter decelerating the mandrel as the log increases in diameter. A suitable drive arrangement for this purpose can be seen in co-owned U.S. Pat. No. 2,995,314.

As mentioned previously, an early form of mandrel was depicted in co-owned U.S. Pat. No. 2,931,590. In the 1960's, this evolved to the mandrel 15 seen in FIG. 2 and designated "PRIOR ART". A feature of this immeditate prior art mandrel was to employ springs 16, 17 adjacent the axial ends of the mandrel to urge the lug release rod 18 toward the cam C at the cam end of the mandrel—here pictured as the left-hand end. The right-hand end—as pictured in FIG. 2—is the bullet end, having a tapered nose portion as at 19 so as to readily receive a core (not shown) in ensleeved relation.

The purpose of the release rod 18 and springs 16, 17 was to urge the core locking lugs 20 into core engaging relation so as to immobilize the core relative to the mandrel 15 during winding. However, during core mounting or core (and roll) removal, the lugs 20 had to be retracted, viz., brought within the cylindrical contour of the mandrel 15. This was and still is done by having the end pin 21—which abuts the left-hand end of the release rod 18—contact the stationary cam C, forcing the end pin 21 and, therefore, the release rod 18 axially to the right in FIG. 2. This causes a pivoting of the lugs 20 into retracted position, so as to free the core of its locking engagement with the mandrel.

Another difference between the prior art showing of FIG. 2 and that of U.S. Pat. No. 2,931,590 was the provision for adjustment of the position of the core locking lugs 20 to hold different thicknesses of cores. With heavy cores, it is normally necessary to allow the core lugs to protrude further from the mandrel than with light, thin cores. To obtain greater protrusion of the core locking lugs 20, the release rod 18 was permitted to travel further to the left (in the illustration given) after it had passed the stationary cam C. This resulted in pivoting the lugs 20 further toward an upright or transverse condition. For this purpose, an adjustment mechanism, generally designated 22 in FIG. 2, was provided. The mechanism included a collar 23 releaseably fixed within the hollow cylindrical mandrel body 15. The collar 23 provided a bore 24 in which the end pin 21 was slidably mounted.

Also fixed within the hollow cylindrical mandrel was a sleeve bearing 25, extending to the right from the fixed collar 23. This sleeve 25 provided a bearing for the movement of a bushing 26. The bushing 26, at its left end, had a threaded bore 27, which received the inner threaded end 21*a* of the end pin 21. At its right-hand end, the bushing was equipped with another threaded bore 28, which received a threaded set screw 29. The set screw 29, in turn, abutted the extreme left-hand end of the release rod 18.

To change the amount of lug protrusion, the end pin 21 was unthreaded from the bushing 26 and the set screw 29 moved to the right or left, as desired, by virtue of inserting an Allen wrench in the wrench socket 30. This had the disadvantage of changing the spring pressure.

The urging of the spring 16—a counterpart of which was found in U.S. Pat. No. 2,931,590—tended to return the release rod 18 to its lug locking position after the end pin 21 no longer engages the stationary cam. This was implemented by virtue of having the release rod 18 equipped with a spring stop 31. Also, the interior of the hollow cylindrical mandrel 15 was equipped with a plurality of axially spaced support blocks 32 for supporting the release rod 18. As can be seen from the left central portion of FIG. 2, the coiled spring 16 is interposed between the most left-hand spacer block 32 and the spring stop 31. Thus, when the biasing force of the stationary cam is removed from the end pin 21, the spring 16 extends and moves the release rod 18 to the left. But the changing of the end position of the release rod 18—by repositioning the set screw 29—also changed the position of the spring stop 31.

As indicated previously, this adjustment, although changing the lug protusion, had the disadvantage of varying the spring pressure on the release rod 15. For example, when the set screw 29 was moved to the left—so as to obtain greater lug protrusion—this lowered the spring pressure by permitting the coiled spring 16 to extend further. Thus, although the lugs were protruding further, they were urged thereto by lower spring pressure and it was felt necessary to employ a second spring, as at 17. This spring 17 is interfaced between a spacer block 32' and a second spring stop 31' fixed to release rod 18.

The provision of this second spring—required to provide sufficient bias to cause the lugs 20 to protrude—resulted in deformation difficulties. The second spring 17 caused the release rod to bow and thereby depart from its axial position. This causes the mandrel to be eccentrically loaded, productive of undesireable vibration at high speeds. However, these drawbacks had to be tolerated until the advent of the instant invention.

The Inventive Mandrel Adjustments

As described hereinbefore, the adjustment mechanism has been improved by providing independent adjustments for lug protrusion and spring pressure. This has permitted the employment of only one spring, which eliminates the deformation difficulties characteristic of the prior art arrangement of FIG. 2. The inventive adjustment arrangement will be described utilizing numerals the same as those employed in FIG. 2 but increased by 100. Thus, in FIG. 3, the mandrel is designated 115, having a bullet end 119 and an end pin 121. Again, the release rod is provided, now designated 118, and is equipped with pivotally mounted lugs 120. Only one spring 116 is provided, however.

Now referring to FIG. 4, which is an enlargement of the extreme left-hand portion of FIG. 3, the lug protrusion mechanism will be described and, in certain respects, it is similar to that previously described in conjunction with FIG. 2. Again, a collar 123 is releasably held in place in the mandrel body, as by set screws 133. However, it is not removed when only the amount of lug protrusion is to be adjusted—but only when spring pressure is to be changed.

For the purpose of changing lug protrusion, the end pin 121 is unthreaded from the bushing 126. Again, the end pin has a threaded end portion 121*a*, which is received within a threaded bore 127 of the bushing 126. The bushing 126 is slidably mounted within the bore 124 of the collar 123.

The bushing 126 is equipped with a second threaded bore 128 into which a set screw 129 is threaded—the bores 127, 128 having opposite threads. After the end pin 121 has been unthreaded from the bushing 126—as by inserting a tool within the opening 121*b*—a screw driver can be inserted within the slot 130 of the set screw 129 so as to advance or retract the set screw 129 and thereby determine the uncammed position of the release rod 118. The release rod 118, at its extreme left-hand end, is equipped with an intergral threaded portion 118*a*, which, at its left end, abuts an unthreaded integral portion 129*a* of the set screw 129.

The spring tension of the spring 116 can be adjusted independently of the uncammed position of the release rod 118. For this purpose, a nut 131 is threadably mounted on the threaded extension 118*a* of the release rod 118. The nut 131 now constitutes an adjustable spring stop in comparison to the non-adjustable spring stop 31 of the prior art showing of FIG. 2.

For adjusting the spring tension, the set screws 133 are loosened and a wrench is applied to the flats 123*a* of the collar 123 and the collar is rotated accordingly. Dowel pins, as at 134, extend from the nut 131 in clearance holes 135 in the collar 123 and thereby rotate the nut 131 along with the collar 123.

By the provision of mechanisms which permit the independent adjustment of lug protrusion and spring tension, we not only maximize the core-biting power of the lugs, but also eliminate the need for the second spring—as at 17—which caused considerable problems in the field and also operated as a speed constraint.

Core Lugs

The invention also provides novel core lugs, which eliminate the difficulties of obtaining proper lug profiles for maximum core-biting power and of achieving proper alignment. The core lugs are illustrated as at 220 in FIG. 5 and are seen to be pivotably mounted by means of pins 236 provided on the release rod 218. The release rod 218 is arcuated recessed as at 237 to accommodate the motion of the lugs 220—as from the protruding position shown in solid line to the retracted position 220' shown in dotted line. Each lug 220 is bifurcated at its inner end by the provision of a slot 238 to provide lug legs 239 and 240. The slot 238 is equipped with opposing arcuate recesses as at 239*a* and 240*a* in the legs 239 and 240. This permits the snap insertion of the lug 220 into the opening 241 in the wall of hollow mandrel body 215. This insertion is facilitated by the diverging confronting walls of legs 239 and 240 at the extremities thereof as at 239*b* and 240*b*.

In the past, the assembly of the prior art mandrels was not only time-consuming, but once the lugs were pinned to the release rod and installed in the mandrel tube, the projecting lugs were scribed, the assembly removed and the lugs filed generally to shape before they were reintroduced into the tube. Thereafter, the lugs were filed in place to the final desired contour, which not only was awkward but could leave file marks on the mandrel tube, which upset the dynamic balance—an important feature with an element that rotates at speeds up to the order of 8,000 rpms.

Through the provision of releasable lugs, all of the foregoing difficulties have been eliminated—the lugs can be filed to the final desired configuration (for biting into the core) without having to go through the onerous stages of disassembly and filing while the lugs are in place. It will be appreciated that this could be an awkward operation when it is considered that the mandrel very often is upwards of eight feet in length and has a diameter of the order of 11½ inches, depending upon the diameter of the paperboard core used to support the wound web roll.

It will be appreciated that the inventive mechanisms and lugs can be used in the prior art style of mandrels and, for that matter, the replaceable lugs by themselves can prove advantageous in the prior art style of mandrels.

While in the foregoing specifications a detailed description of the invention has been set down for the purpose of explanation, many variations in the details herein given may be made by those skilled in the art without departing from the spirit and scope of the invention.

We claim:

1. In a mandrel structure adapted for use in web rewinding operations, an elongated hollow mandrel provided with a plurality of openings in the circumferential wall thereof, means supporting and rotatably driving said mandrel adjacent one end thereof, said mandrel being adapted to receive a core thereon from the other end thereof, spaced apart support members mounted within said mandrel and having aligned bores therethrough lying on the longitudinal axis of the mandrel, a core locking rod, slidably and axially mounted within said bores and being equipped with a plurality of core-locking lugs aligned with said openings and being movable inwardly and outwardly therethrough upon axial movement of said rod relative to said mandrel, said rod adjacent said one end being equipped with adjustable spring stop means, a spring interposed between said stop means and one of said support members, first means accessible from said mandrel one end for adjusting the position of said stop means and thereby the spring pressure urging said rod toward said mandrel one end, and second means accessible from said mandrel one end for adjusting the location of said rod independent of said spring pressure adjustment means.

2. The mandrel according to claim 1, in which said lugs are releasably mounted on said rod for removal and replacement through said openings.

3. The structure of claim 2, in which each of said lugs is a unitary member, having a first end adapted to protrude out of said mandrel and having a generally transverse surface adapted to engage the interior of a core, said lug adjacent the other end thereof being bifurcated to provide a pair of spaced apart legs, said legs in confronting portions thereof being equipped with arcuate recesses for engagement with pins on said core locking rod.

4. The structure of claim 1, in which said adjustable spring stop means includes an integral threaded end portion on said rod adjacent said mandrel one end, a nut threadably mounted on said rod end portion, and means accessible from said mandrel one end for rotating said nut.

5. For a driven mandrel, having a hollow cylindrical tube and axially spaced apertured rod support blocks, a core locking rod having spaced lug supporting means and one end equipped with thread means, said rod being adapted to be supported in said blocks with said rod one end adapted to be positioned adjacent the driven end of said mandrel, a nut threadably mounted on said thread means and adapted to provide an adjustable stop for a spring adapted to urge said rod in the direction of said one end, and an adjustable mechanism adapted to be mounted in said mandrel driven end, said mechanism including collar means providing a bore axially aligned with said release rod, means operably associated with said bushing for adjusting the limit of travel of said rod under the urging of said spring and means operably associated with said collar for adjusting the position of said nut and thereby the urging pressure of said spring.

6. A locking lug for a mandrel mountable and replacable through the mandel openings comprising a relatively elongated unitary member having a first end adapted to protrude out of said mandrel and having a generally transverse surface adapted to engage the interior of a core, said member adjacent the other end thereof being bifurcated to provide a pair of spaced apart legs, said legs in confronting portions thereof being equipped with arcuate recesses for engagement with a mandrel rod pin.

* * * * *